US011391050B2

(12) United States Patent
Pervan

(10) Patent No.: US 11,391,050 B2
(45) Date of Patent: Jul. 19, 2022

(54) MECHANICAL LOCKING SYSTEM FOR FLOOR PANELS

(71) Applicant: Ceraloc Innovation AB, Viken (SE)

(72) Inventor: Darko Pervan, Viken (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

(21) Appl. No.: 16/822,130

(22) Filed: Mar. 18, 2020

(65) Prior Publication Data

US 2020/0217083 A1 Jul. 9, 2020

Related U.S. Application Data

(63) Continuation of application No. 15/901,614, filed on Feb. 21, 2018, now Pat. No. 10,626,620, which is a continuation of application No. 15/028,831, filed as application No. PCT/SE2014/051251 on Oct. 24, 2014, now Pat. No. 10,041,258.

(30) Foreign Application Priority Data

Oct. 25, 2013 (SE) ..... 1351273-6

(51) Int. Cl.
*E04F 15/02* (2006.01)
*E04F 15/10* (2006.01)

(52) U.S. Cl.
CPC ..... *E04F 15/02038* (2013.01); *E04F 15/10* (2013.01); *E04F 2201/0161* (2013.01); *E04F 2201/041* (2013.01); *E04F 2201/0517* (2013.01)

(58) Field of Classification Search
CPC ..... E04F 2201/0153; E04F 15/04; E04F 2201/0517; E04F 15/02; E04F 2201/0115; E04F 15/02038
See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |
| 213,740 | A | 4/1879 | Conner |

(Continued)

FOREIGN PATENT DOCUMENTS

| | | | |
|---|---|---|---|
| CN | 201588375 | U | 9/2010 |
| CN | 102383575 | A | 3/2012 |

(Continued)

OTHER PUBLICATIONS

International Search Report and Written Opinion issued in PCT/SE2014/051251, dated Mar. 16, 2015, Patent-och registreringsverket, Stockholm, SE, 15 pages.

(Continued)

*Primary Examiner* — Babajide A Demuren
*Assistant Examiner* — Daniel J Kenny
(74) *Attorney, Agent, or Firm* — Buchanan Ingersoll & Rooney P.C.

(57) ABSTRACT

Building panels, especially floor panels are shown, which are provided with a locking system comprising several clips connected to a panel edge comprising a recess formed in a lower lip or in the tongue. Each clip may include an upwardly extending locking element, which is configured to cooperate with a locking groove for locking the two edges in a horizontal direction.

18 Claims, 10 Drawing Sheets

(56) References Cited

U.S. PATENT DOCUMENTS 274,354 A 3/1883 McCarthy et al.
876,693 A 1/1908 Coldwell
1,898,364 A 2/1933 Gynn
2,110,728 A 3/1938 Hoggatt
2,430,200 A 11/1947 Wilson
2,889,016 A 6/1959 Warren
3,099,110 A 7/1963 Spaight
3,147,522 A 9/1964 Schumm
3,187,612 A 6/1965 Hervey
3,731,445 A 5/1973 Hoffmann et al.
3,939,546 A 2/1976 Hernandez
4,169,688 A 10/1979 Toshio
4,426,820 A 1/1984 Terbrack et al.
4,447,172 A 5/1984 Galbreath
4,512,131 A 4/1985 Laramore
4,599,841 A 7/1986 Haid
4,819,932 A 4/1989 Trotter, Jr.
5,135,597 A 8/1992 Barker
5,272,850 A 12/1993 Mysliwiec et al.
5,295,341 A 3/1994 Kajiwara
5,435,610 A 7/1995 Roberts
5,485,702 A 1/1996 Sholton
5,577,357 A 11/1996 Civelli
5,845,548 A 12/1998 Nelson
5,860,267 A 1/1999 Pervan
5,950,389 A 9/1999 Porter
5,970,675 A 10/1999 Schray
6,006,486 A 12/1999 Moriau et al.
6,094,882 A 8/2000 Pervan
6,182,410 B1 2/2001 Pervan
6,203,653 B1 3/2001 Seidner
6,205,639 B1 3/2001 Pervan
6,254,301 B1 7/2001 Hatch
6,295,779 B1 10/2001 Canfield
6,332,733 B1 12/2001 Hamberger
6,339,908 B1 1/2002 Chuang
6,358,352 B1 3/2002 Schmidt
6,418,683 B1 7/2002 Martensson et al.
6,449,918 B1 9/2002 Nelson
6,450,235 B1 9/2002 Lee
6,490,836 B1 12/2002 Moriau et al.
6,550,206 B2 4/2003 Lee
6,576,079 B1 6/2003 Kai
6,584,747 B2 7/2003 Kettler et al.
6,591,568 B1 7/2003 Pålsson
6,681,820 B2 1/2004 Olofsson
6,685,391 B1 2/2004 Gideon
6,729,091 B1 5/2004 Martensson
6,763,643 B1 7/2004 Martensson
6,802,166 B1 10/2004 Durnberger
6,851,241 B2 * 2/2005 Pervan ..... E04F 15/04 52/592.1
6,854,235 B2 2/2005 Martensson
6,862,855 B1 3/2005 Milum et al.
6,880,307 B2 4/2005 Schwitte et al.
7,040,068 B2 5/2006 Moriau et al.
7,051,486 B2 5/2006 Pervan
7,108,031 B1 9/2006 Secrest
7,171,790 B2 2/2007 Mei
7,243,470 B2 7/2007 Chae
7,257,926 B1 8/2007 Kirby et al.
7,637,068 B2 12/2009 Pervan
7,654,055 B2 2/2010 Ricker
7,677,005 B2 3/2010 Pervan
7,716,889 B2 5/2010 Pervan
7,757,452 B2 7/2010 Pervan
7,805,903 B2 10/2010 Liu
7,841,150 B2 11/2010 Pervan
7,908,815 B2 3/2011 Pervan et al.
7,980,039 B2 7/2011 Groeke
8,156,705 B2 4/2012 Alford et al.
8,181,416 B2 5/2012 Pervan et al.
8,234,830 B2 8/2012 Pervan et al.
8,276,343 B2 10/2012 Yang
8,302,367 B2 11/2012 Schulte
8,336,272 B2 12/2012 Prager et al.
8,341,915 B2 1/2013 Pervan et al.
8,429,870 B2 4/2013 Chen et al.
8,448,402 B2 5/2013 Pervan et al.
8,650,826 B2 * 2/2014 Pervan ..... E04F 15/02038 52/582.1
8,733,410 B2 5/2014 Pervan
8,763,340 B2 7/2014 Pervan et al.
9,243,411 B2 1/2016 Pervan et al.
9,314,936 B2 4/2016 Pervan
9,657,483 B2 5/2017 Pervan et al.
10,041,258 B2 8/2018 Pervan
10,221,576 B2 3/2019 Pervan et al.
10,626,620 B2 4/2020 Pervan
10,697,187 B2 6/2020 Pervan et al.
2001/0010139 A1 8/2001 De Kerpel
2001/0024707 A1 9/2001 Andersson et al.
2002/0095894 A1 7/2002 Pervan
2003/0037504 A1 2/2003 Schwitte et al.
2003/0084636 A1 5/2003 Pervan
2003/0101674 A1 6/2003 Pervan et al.
2003/0180091 A1 9/2003 Stridsman
2004/0016196 A1 1/2004 Pervan
2004/0139676 A1 7/2004 Knauseder
2004/0144050 A1 7/2004 Kellner
2004/0182033 A1 9/2004 Wernersson
2004/0206036 A1 10/2004 Pervan
2004/0211143 A1 10/2004 Hannig
2004/0244325 A1 12/2004 Nelson
2004/0250492 A1 12/2004 Becker
2005/0028474 A1 2/2005 Kim
2005/0050827 A1 3/2005 Schitter
2005/0102937 A1 5/2005 Pervan
2005/0160694 A1 7/2005 Pervan
2005/0252130 A1 11/2005 Martensson
2006/0070333 A1 4/2006 Pervan
2006/0156670 A1 7/2006 Knauseder
2006/0236642 A1 10/2006 Pervan
2006/0260254 A1 11/2006 Pervan
2007/0028547 A1 2/2007 Grafenauer et al.
2007/0151189 A1 7/2007 Yang et al.
2007/0220822 A1 9/2007 Permesang
2008/0000182 A1 1/2008 Pervan
2008/0028707 A1 2/2008 Pervan
2008/0041008 A1 2/2008 Pervan
2008/0110125 A1 5/2008 Pervan
2008/0134607 A1 6/2008 Pervan
2008/0216434 A1 9/2008 Pervan
2008/0216920 A1 9/2008 Pervan
2009/0019806 A1 1/2009 Muehlebach
2009/0056339 A1 3/2009 Fischer et al.
2009/0107076 A1 4/2009 Kim
2009/0133353 A1 5/2009 Pervan et al.
2009/0151290 A1 6/2009 Liu
2009/0193741 A1 8/2009 Capelle
2009/0193748 A1 8/2009 Boo et al.
2010/0132295 A1 * 6/2010 Bootier ..... E04F 13/0841 52/520
2010/0170189 A1 7/2010 Schulte
2010/0173122 A1 7/2010 Susnjara
2010/0300029 A1 12/2010 Braun
2011/0016815 A1 1/2011 Yang
2011/0113713 A1 5/2011 Lui
2011/0131916 A1 6/2011 Chen
2011/0167751 A1 7/2011 Engström
2011/0197535 A1 8/2011 Baker et al.
2011/0271632 A1 11/2011 Cappelle et al.
2012/0096801 A1 4/2012 Cappelle
2012/0192521 A1 8/2012 Schulte
2013/0008117 A1 1/2013 Pervan
2013/0014463 A1 1/2013 Pervan
2013/0019555 A1 1/2013 Pervan
2013/0036695 A1 2/2013 Durnberger
2013/0042562 A1 2/2013 Pervan
2013/0042563 A1 2/2013 Pervan et al.
2013/0042564 A1 2/2013 Pervan et al.
2013/0042565 A1 2/2013 Pervan
2013/0047536 A1 2/2013 Pervan
2013/0055950 A1 3/2013 Pervan

(56) References Cited

U.S. PATENT DOCUMENTS

| | | | |
|---|---|---|---|
| 2013/0160390 | A1 | 6/2013 | Stockl |
| 2014/0157700 | A1 | 6/2014 | Martensson |
| 2014/0223852 | A1 | 8/2014 | Pervan |
| 2014/0287194 | A1 | 9/2014 | Pervan et al. |
| 2014/0335273 | A1 | 11/2014 | Haller |
| 2016/0060880 | A1 | 3/2016 | Stover et al. |
| 2016/0168865 | A1 | 6/2016 | Pervan |
| 2016/0201337 | A1 | 7/2016 | Pervan et al. |
| 2016/0237695 | A1 | 8/2016 | Pervan |
| 2016/0356048 | A1 | 12/2016 | Stover et al. |
| 2017/0234020 | A1 | 8/2017 | Pervan et al. |
| 2018/0179764 | A1 | 6/2018 | Pervan |
| 2019/0161977 | A1 | 5/2019 | Pervan et al. |
| 2019/0383026 | A1 | 12/2019 | Bergelin et al. |

FOREIGN PATENT DOCUMENTS

| | | | |
|---|---|---|---|
| DE | 138 992 | C | 7/1901 |
| DE | 142 293 | C | 7/1902 |
| DE | 2 159 042 | A1 | 6/1973 |
| DE | 2 159 042 | C3 | 6/1973 |
| DE | 33 10 281 | A1 | 10/1984 |
| DE | 33 43 601 | A1 | 6/1985 |
| DE | 33 43 601 | C2 | 6/1985 |
| DE | 42 15 273 | A1 | 11/1993 |
| DE | 42 42 530 | A1 | 6/1994 |
| DE | 196 01 322 | A | 5/1997 |
| DE | 200 02 744 | U1 | 8/2000 |
| DE | 10 2006 020 135 | A1 | 11/2007 |
| EP | 1 120 515 | A1 | 8/2001 |
| EP | 1 146 182 | A2 | 10/2001 |
| EP | 1 441 086 | A1 | 7/2004 |
| EP | 1 640 530 | A2 | 3/2006 |
| EP | 1 373 658 | B1 | 12/2006 |
| EP | 2 397 623 | A1 | 12/2011 |
| EP | 2 492 416 | A1 | 8/2012 |
| EP | 2 670 928 | | 12/2013 |
| EP | 2 670 928 | B1 | 6/2017 |
| ES | 1070838 | U | 11/2009 |
| FR | 2 810 060 | A1 | 12/2001 |
| JP | H06-146553 | A | 5/1994 |
| WO | WO 94/26999 | A1 | 11/1994 |
| WO | WO 96/27721 | A1 | 9/1996 |
| WO | WO 97/47834 | A1 | 12/1997 |
| WO | WO 98/21428 | A1 | 5/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/47841 | A1 | 8/2000 |
| WO | WO 01/75247 | A1 | 10/2001 |
| WO | WO 02/05581 | A1 | 7/2002 |
| WO | WO 02/055809 | A1 | 7/2002 |
| WO | WO 03/083234 | A1 | 10/2003 |
| WO | WO 2006/043893 | A1 | 4/2006 |
| WO | WO 2006/104436 | A1 | 10/2006 |
| WO | WO 2007/015669 | A2 | 2/2007 |
| WO | WO 2007/015669 | A3 | 2/2007 |
| WO | WO 2007/142589 | A1 | 12/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/017281 | A1 | 2/2008 |
| WO | WO 2009/075998 | A2 | 6/2009 |
| WO | WO 2010/087752 | A1 | 8/2010 |
| WO | WO 2011/127981 | A1 | 10/2011 |
| WO | WO 2012/045343 | A1 | 4/2012 |
| WO | WO 2013/041264 | A1 | 3/2013 |

OTHER PUBLICATIONS

Extended European Search Report issued in EP 14856454.5, dated May 18, 2017, European Patent Office, Munich, DE, 11 pages.

Extended European Search Report issued in EP 19167121.3, dated May 16, 2019, European Patent Office, Munich, DE, 11 pages.

Laminate Flooring Tips (http://flooring.lifetips.com/cat/61734/laminate-flooring-tips/index.html). Copyright 2000. 12 pages.

Pervan, Darko (Author), Technical Disclosure entitled "VA070 Strip Part," IP com No. IPCOM000210867D, Sep. 13, 2011, IP.com Prior Art Database, Accession No. AN XP013144908; 43 pages.

* cited by examiner

KNOWN TECHNOLOGY

MECHANICAL LOCKING SYSTEM FOR FLOOR PANELS

CROSS REFERENCE TO RELATED APPLICATIONS

The present application is a continuation of U.S. application Ser. No. 15/901,614, filed on 21 Feb. 2018, which is a continuation of U.S. application Ser. No. 15/028,831, filed on Apr. 12, 2016, now U.S. Pat. No. 10,041,258, which is a U.S. National Stage of International Application No. PCT/SE2014/051251, filed on Oct. 24, 2014, which claims the benefit of Swedish Application No. 1351273-6, filed on Oct. 25, 2013. The entire contents of each of U.S. application Ser. No. 15/901,614, U.S. application Ser. No. 15/028,831, International Application No. PCT/SE2014/051251, and Swedish Application No. 1351273-6 are hereby incorporated herein by reference in their entirety.

TECHNICAL FIELD

The disclosure generally relates to the field of mechanical locking systems for floor panels and building panels. The disclosure shows floorboards, locking systems and production methods.

FIELD OF APPLICATION

The present invention is particularly suitable for use in thin floating floors, which are formed of floor panels which are joined mechanically with a locking system preferably integrated with the floor panel, i.e. mounted at the factory, are made up of one or more upper layers of thermoplastic or thermosetting material or wood veneer, an intermediate core of wood-fibre-based material or plastic material and preferably a lower balancing layer on the rear side of the core. The invention can also be used for joining building panels which preferably contain a board material for instance wall panels, ceilings, furniture components and similar. Parts of the locking system may also be supplied as separate components, which may be connected to a panel during installation.

The following description of prior-art technique, problems of known systems and objects and features of the invention will therefore, as a non-restrictive example, be aimed above all at this field of application and in particular at thin panels formed as rectangular floor panels with long and shorts edges intended to be mechanically joined to each other on both long and short edges.

The long and short edges are mainly used to simplify the description of the invention. The panels may be square. It should be emphasized that the invention can be used in any floor panel on long and/or short edges and it may be combined with all types of known locking system that lock the panels in the horizontal and/or vertical direction.

The following description of prior-art technique, problems of known systems and objects and features of the invention will, as a non-restrictive example, be aimed above all at floor panels and especially at thin resilient thermoplastic floor panels such as so called luxury vinyl tiles, generally referred to as LVT,

BACKGROUND OF THE INVENTION

LVT flooring usually comprises a transparent wear layer which may be coated by a UV cured PU lacquer, a decorative plastic foil and one or several core layers which generally are of different density and hardness. Relevant parts of this prior art description are also a part of the invention.

Thin LVT floors with a thickness of 2-3 mm have traditionally been installed by gluing to the sub floor. Recently LVT floors have been introduced on the market that comprises a mechanical locking system, which allows a floating installation without glue. This facilitates installation and eliminates a lot of work to prepare the sub floor for gluing.

Such LVT floors have generally a thickness of about 5 mm. This thickness is mainly required in order to form the locking system. The panel itself is strong and flexible and a thickness of about 3 mm would in many application be sufficient but cannot be used since it is not possible to form a strong and cost efficient locking system in such thin floors.

Such problems related to minimum thickness requirements due to the forming of locking systems are also applicable in other thin floor panels such as laminate floors and wood powder based floors where material and weight savings may be accomplished with lower thicknesses, preferably below 6 mm.

Laminate flooring usually comprise a core of a 6-12 mm fibre board, a 0.2-0.8 mm thick upper decorative surface layer of laminate and a 0.1-0.6 mm thick lower balancing layer of laminate, plastic, paper or like material. A laminate surface comprises melamine-impregnated paper. The most common core material is fibreboard with high density and good stability usually called HDF—High Density Fibreboard. Sometimes also MDF—Medium Density Fibreboard—is used as core.

Laminate floor panels of this type have been joined mechanically by means of so-called mechanical locking systems. These systems comprise locking means, which lock the panels horizontally and vertically. The mechanical locking systems are usually formed by machining of the core of the panel. Alternatively, parts of the locking system can be formed of a separate material, for instance aluminium or HDF, which are integrated with the floor panel, i.e. joined with the floor panel in connection with the manufacture thereof.

The main advantages of floating floors with mechanical locking systems are that they are easy to install. They can also easily be taken up again and used once more at a different location.

DEFINITION OF SOME TERMS

In the following text, the visible surface of the installed floor panel is called "front side", while the opposite side of the floor panel, facing the sub floor, is called "rear side". The edge between the front and rear side is called "joint edge". By "horizontal plane" is meant a plane, which extends parallel to the front side. Immediately juxtaposed upper parts of two adjacent joint edges of two joined floor panels together define a "vertical plane" perpendicular to the horizontal plane. By "vertical locking" is meant locking parallel to the vertical plane. By "horizontal locking" is meant locking parallel to the horizontal plane. By "up" is meant towards the front side, by "down" towards the rear side, by "inwardly" mainly horizontally towards an inner and centre part of the panel and by "outwardly" mainly horizontally away from the centre part of the panel.

RELATED ART AND PROBLEMS THEREOF

For mechanical joining of long edges as well as short edges in the vertical and horizontal direction perpendicular to the edges several methods may be used. One of the most used methods is the angle-snap method. The long edges are installed by angling. The short edges are locked by horizontal snapping. The vertical connection is generally a tongue and a groove and the horizontal connection is a strip with a locking element that cooperates with a locking groove in the adjacent edge.

Similar locking systems may also be produced with a rigid strip and they are connected with an angling-angling method where both short and long edges are angled into a locked position.

Advanced so-called fold down locking systems with a separate and flexible tongue on the short edges have been introduced where both the long and short edges are locked with an angling action.

It is known that a locking strip may be formed of a separate material such as aluminium and that such strip may be clamped in undercut grooves. Such systems are described in WO94/26999. The separate metal strip may be used to lock very thin panes with a thickness of about 3 mm provided that the core is made of a strong material for example compact laminate or a high quality HDF and that the strip extends along essentially the whole edge. The strip is used to accomplish vertical and horizontal locking.

WO 99/66152 describes a locking system with a tongue and a tongue groove and a separate metal strip that is attached to the lower lip of the tongue groove and that in locked position is located vertically under the tongue. Such locking system is not suitable for thin flooring since the thickness must be sufficient to form the tongue groove and a connecting part for the strip under the groove. Generally ⅓ of the panel thickens is used to form the upper lip, ⅓ is used to form the tongue and ⅓ remains to form the lower lip, The available material thickness that may be used to form the strip under the tongue is generally less than ⅓ of the panel thickness. A connection to the outer part of the lower lip is also disadvantage in panels with a soft and flexible core such as LVT. A lower lip formed in soft and flexible material bends downwards when the strip is exposed to rather low separation forces and a strong strip will not improve the locking strength due to inferior connection to the panel edge.

It is known from CN 201588375 that clips may be used to accomplish horizontal and vertical locking. Such clips may provide cost advantages over a locking strip that extends along the whole edge. A disadvantage is that a considerable part of the edge between the clips is not locked vertically and the edges will move vertically when exposed to high load especially if the floor panels are thin and flexible.

US 2001/0010139 A1 shows a locking system similar to embodiments shown in WO 94/26999. A separate clip is connected to an outer part of a lower lip that is positioned beyond an upper lip. The geometry of the lower lip, the tongue and the tongue groove is not suitable to form a strong locking in soft and flexible core materials.

It is also known from WO 2013/025165 that a tongue and a groove formed in one piece with the core may be used for vertical locking and several strip parts spaced form each other may be attached to an edge in order to obtain horizontal locking. A disadvantage is that such locking system are not suitable for thin floors since the strip part is connected in a separate groove that extend along the whole edge and that is located under the lower part of the tongue. The connection of the strip part is not sufficient to prevent backwards bending of the strip body and edge separation when the edges are exposed to pulling forces. This is a disadvantage in thin laminate floors and floors with a rather soft core such as LVT floors.

It would be an advantage if separate clips that comprise a stronger material than the core may be used to accomplish a horizontal locking in thin floors and if such horizontal locking may be combined with a vertical locking comprising a tongue and a grove that extends along the whole edge and is made in one piece with the core.

SUMMARY OF THE INVENTION AND OBJECTS THEREOF

An overall objective of the present invention is to provide an improved and more cost efficient locking system for primarily adjacent long edges of thin and flexible floor panels that may be locked to each with angling.

A first specific objective is to provide a locking system for thin flooring comprising a tongue and groove for vertical connection and a separate clip that may be attached to the panel edge and provide a strong locking in panels with a thin and flexible core.

A second specific objective is to provide a flooring system comprising two types of panels that may be locked in a more flexible way in order to allow installation of advanced floor patterns.

The above objects of the invention may be achieved by embodiments of the invention.

According to a first aspect of the invention building panels are provided with a locking system comprising a tongue at a second edge of a second panel. The tongue is configured to cooperate with a tongue groove at a first edge of a first panel for locking in a vertical direction. The tongue groove comprises an upper lip and a lower lip. The locking system further comprises one or more clips attached to the first edge and a downwardly open locking groove formed at the second edge. Each clip comprises an upwardly extending locking element, which is configured to cooperate with the locking groove for locking the first edge and the second edge in a horizontal direction. The clip comprises a clip body at a rear side of the first panel. Said clip body is provided with an inner part, which extends inwardly from the first edge and an outer part, which extends outwardly from said first edge. The inner part comprises a fixing element that cooperates with a downwardly open fixing groove, formed on the rear side of the first panel, for locking the clip to the first edge in a horizontal direction. The clip comprises a locking protrusion that protrudes upwardly from the clip body. The locking protrusion is configured to lock the clip to the first edge in a vertical direction. The lower lip of the tongue groove comprises a recess and the locking protrusion is in a locked position positioned in the recess.

The locking protrusion may have a part that is located in the tongue groove.

A part of the locking protrusion may be located below the tongue.

The locking protrusion may be spaced horizontally inwardly in the tongue groove beyond the outer tip of the tongue.

The locking protrusion may comprise a first part that extends upwardly from the clip body and a second part that extends inwardly into the tongue groove.

The locking protrusion may be located inwardly and spaced horizontally from the vertical plane The panel may comprise a core of plastic material.

The panel may comprise a surface of thermoplastic material.

The panel may comprise a core with an upper core layer and a lower core layer and the locking protrusion may protrude vertically beyond the lower core layer.

According to a second aspect of the invention a flooring system is provided comprising a first panel and a second panel provided with a locking system comprising clips. Said clips being arranged at a first edge and at an opposite second edge of the first and the second panel. The locking system is configured to lock the first edge of the first panel to the second edge of the second panel in a horizontal and a vertical direction.

The first edge and the second edge may each comprises a horizontal groove comprising a lower lip.

Each clip may comprise a vertically extending locking protrusion with an upper part that is located essentially above the lower lip of the first and the second panel, respectively.

Each lower lip may be spaced horizontally and inwardly from an upper part of the edge.

BRIEF DESCRIPTION OF THE DRAWINGS

The disclosure will in the following be described in connection to exemplary embodiments and in greater detail with reference to the appended exemplary drawings, wherein.

DESCRIPTION OF EMBODIMENTS OF THE INVENTION

Figure 1A:
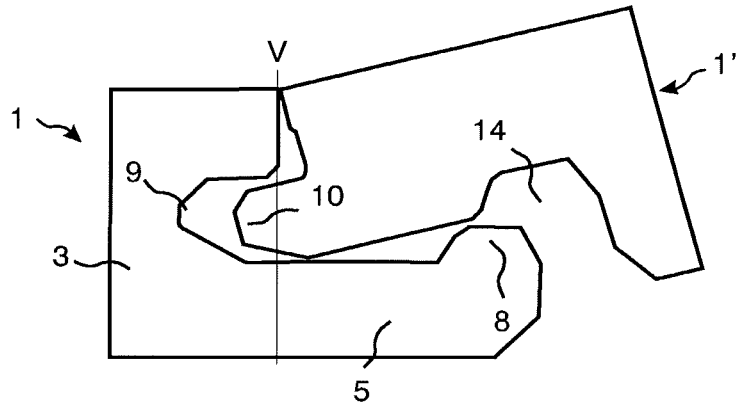
FIGS. 1*a-f* illustrates locking systems according to known technology.

FIGS. 1*a*-1*f* show known locking systems. FIG. 1*a* shows a conventional locking system formed in one piece with the core 5 and configured to lock with angling. The floor panel 1, 1' comprises a locking system that has a tongue 10 and a tongue groove 9 that lock vertically and a strip 5 with a locking element 8 that cooperates with a locking groove 14 and locks the edges horizontally.

Figure 1B:
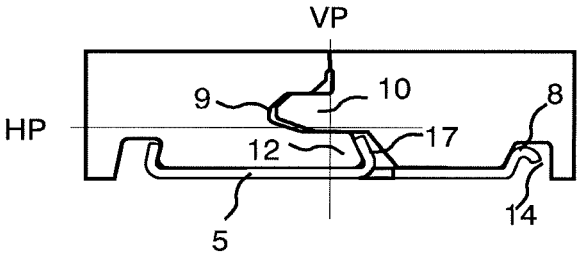
Figure 1C:
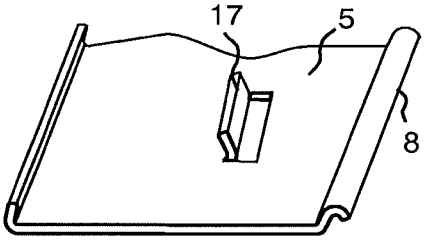

FIG. 1*b* and 1*c* shows a locking system with a separate strip 5 that comprises a locking protrusion 17 connected to a lower lip 12 of the tongue groove 9 that protrudes beyond a vertical plane VP. The locking protrusion 17 is located under a horizontal plane HP that intersects the lower part of the tongue 10. Such locking system may not provide sufficient locking strength in thin and flexible core material since the lower lip 12 and the outer part of the strip 5 will bend downwards when the edges are exposed to pulling forces and the locking element 8 will slide out from the locking groove 14.

Figure 1D:
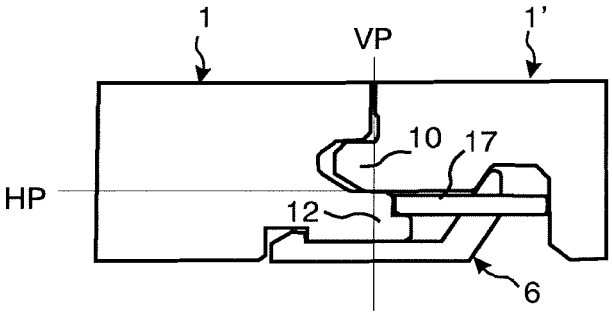
Figure 1E:
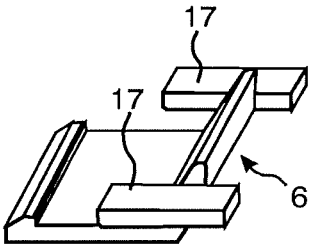
Figure 1F:
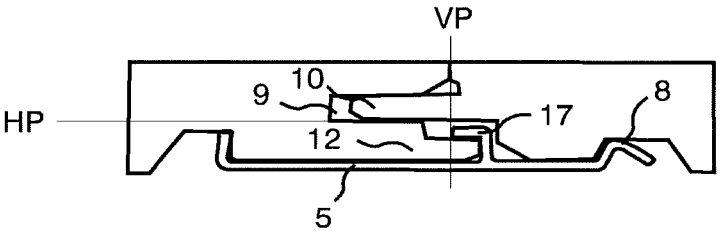

FIGS. 1*d*-1*f* show similar locking systems comprising a plastic or metal clip 6 with a locking protrusion 17 connected to an upper part of the lower lip 12 which is located under the tongue 10 and under the cooperating locking surfaces between the tongue and the lower lip 12. The clip is connected to an outer part of a lower lip 12 that is positioned beyond the upper lip and beyond the vertical plane VP.

To facilitate understanding of the described invention, several locking systems in the figures are shown schematically. It should be emphasized that improved or different functions can be achieved using combinations of the preferred embodiments.

All embodiments may be used separately or in combinations. Angles, dimensions, rounded parts, spaces between surfaces etc. are only examples and may be adjusted within the basic principles of the invention.

FIGS. 2*a*-2*f* show a first embodiment of the invention.

Figure 2A:
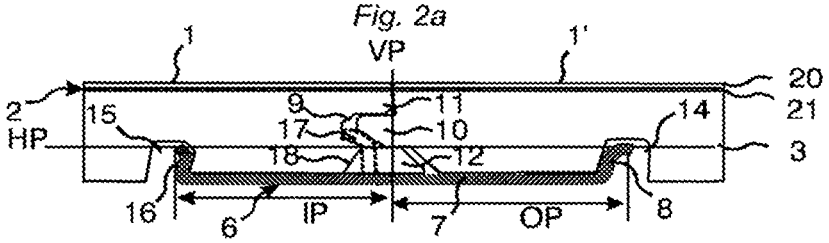
FIGS. 2*a-f* illustrate a clip that may be used to lock thin floor panels according to an embodiment of the invention.

FIG. 2*a* show a cross section of a first and second panel 1, 1' each provided with a surface layer 2 comprising a transparent wear layer 20 which may be coated by a UV cured PU lacquer. The first and the second panels 1, 1' are preferably LVT panels. A decorative plastic foil 21 is attached to a core 3 and under the transparent layer 20. The core 3 that preferably comprises a thermosetting plastic material with a filler may have several core layers, which may have different density and hardness. The locking system comprises a tongue 10 at the second edge of the second panel 1', a tongue groove 9 at a first edge of the first panel and a clip 6, that preferably is formed by punching a metal sheet, for example a 0.3-0.6 mm aluminium or steel sheet. The clip 6 comprises a clip body 7 at a rear side of a first panel 1. The clip body comprises an inner part IP that extends inwardly from a first edge of the first panel and an outer part OP that extends outwardly from the first edge of the first panel 1.

The clip 6 comprises a fixing element 16 located in a fixing groove 15 in the first panel 1 and a locking element 8 located in a locking groove 14 formed in an adjacent second panel 1' that lock the panel edges horizontally and prevents horizontal separation. The clip 6 comprises a locking protrusion 17 formed on the strip body 7 between the locking element 8 and the fixing element 16. The locking protrusion 17 projects vertically upwardly from the strip body and is located in a recess 18 formed in the lower lip 12 of the tongue groove 9. The recess 18 extends vertically from an upper to a lower part of the lower lip 12. The locking protrusion 17 is in this embodiment located such that it is displaced inwardly from the vertical plane VP. A part of the locking protrusion 17 extends inwardly into the tongue groove 9 and beyond the outer part of the tongue 10. An upper part of the locking protrusion 17 is preferably located above a horizontal plane HP that intersects the lower part of the tongue 10 and the upper part of the lower lip 12. The locking protrusion 17 connects the clip 6 vertically to the first panel 1 edge and prevents downward bending of the clip 6 when the edges of the first 1 and the second 1' panels are exposed to separation forces. The locking protrusion 17 prevents a displacement of the clip 6 inwardly such that the clip 6 is accurately fixed and positioned in a pre-determined position by the locking protrusion 17 and the fixing element 16.

An advantage is that the clip 6 may be connected to the core 3 in a horizontal plane HP that is located above the lower lip 12 and to an edge part that is more rigid than an outer part of the lower lip. The whole vertical extension of the lower lip 12 and tongue groove 9 may be used to accomplish a strong connection without any essential negative effect on the vertical tongue 10 and tongue groove 9 connection since only a small part of the lower lip 12 will be partially removed when the recess 18 is formed. The upper contact surfaces between the tongue 10 and the upper lip 11 are unchanged and may provide an unchanged sealing against moisture penetration into the joint. The locking protrusion may be connected to an edge part that comprises sufficient material to allow a strong connection even when the panels are thin for example 3-4 mm and comprise a core 3 of flexible material, such as thermoplastic material mixed with a filler, which is a material composition generally used in LVT floors.

Figure 2B:
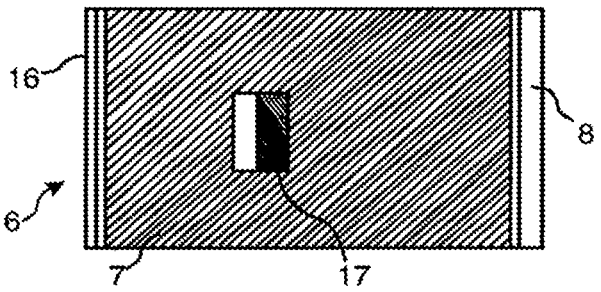
Figure 2C:
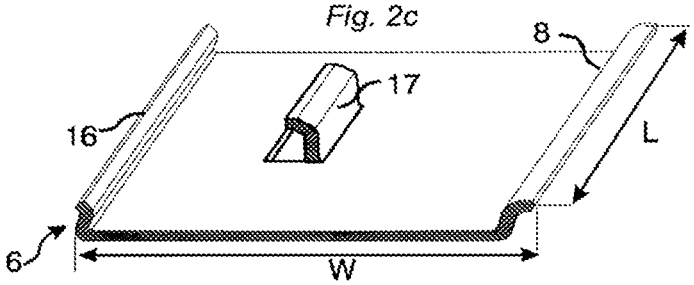

FIG. 2*b* is a top view of the clip 6. FIG. 2*c* shows a clip 6 that has a length direction L along the edge and a width direction W perpendicular to the length. A clip with a length of about 3 cm and a width of about 2 cm may provide a locking strength that corresponds to a pulling force of about 200 N. 10 clips/m are sufficient to provide a locking strength on a long edge of about 2000 N.

Figure 2D:
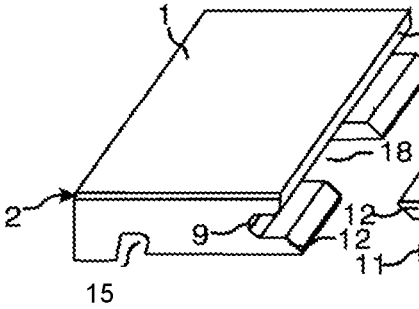

FIG. 2*d* shows an edge section 1 that comprises a recess 18 formed in the lower lip 12.

Figure 2E:
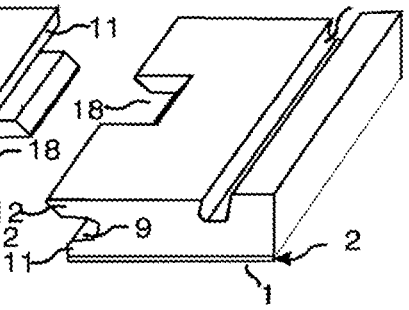

FIG. 2*e* shows the same edge section 1 with the surface layer 2 pointing downwards and the recess 18 formed in the lower lip 12.

Figure 2F:
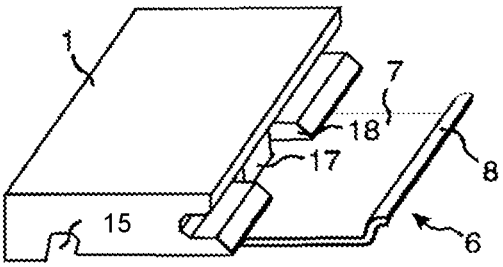

FIG. 2*f* shows a clip 6 connected to an edge section 1. The locking protrusion is located in a recess 18 formed in the lower lip 12.

Figure 3A:
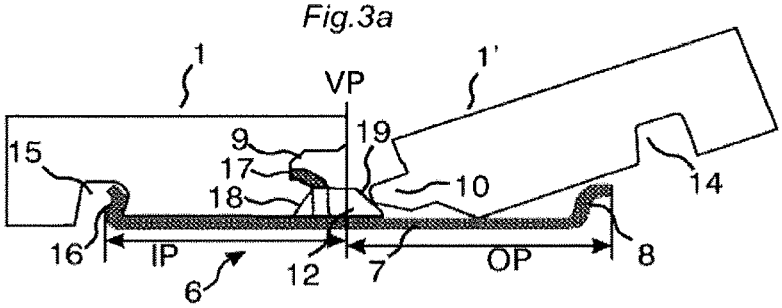
FIGS. 3*a-h* illustrate clips and a production methods to connect a clip to an edge according to embodiments of the invention.

FIG. 3*a* shows that the locking system may be locked with angling. The lower lip 12 comprises preferably a sliding surface 19 that guides the tongue 10 into the tongue groove 9 during angling but also during horizontal snapping. The sliding surface 19 and a part of the lower lip 12 are located above the outer part OP of the clip body 7

Figure 3B:
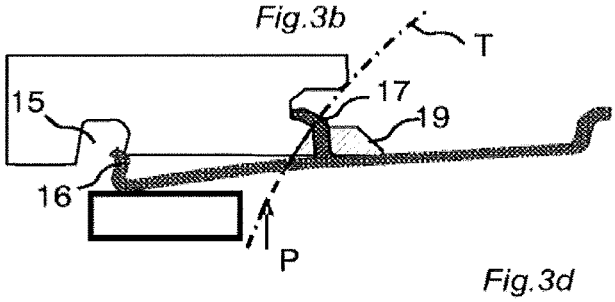

FIG. 3*b* shows that the clip 6 may be connected with angling and pressing of the fixing element 16 with a pressing tool P into the fixing groove 15. The recess 19 is preferably formed by a vertically rotating tool T that cuts the edge as a saw blade.

Figure 3C:
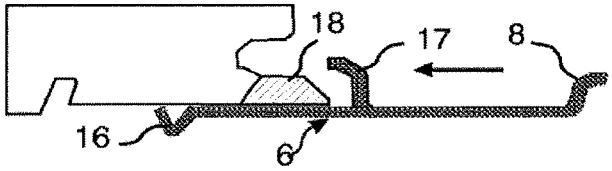
Figure 3D:
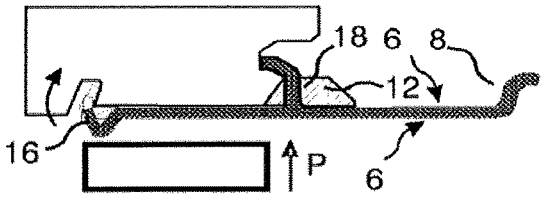
Figure 3E:
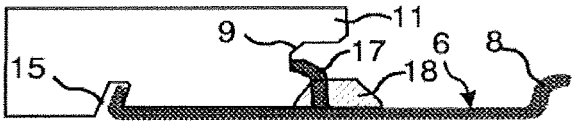

FIGS. 3*c*, 3*d* and 3*e* show that the clip 6 may be connected by a horizontal displacement and pressing against the fixing element 16 such that a bending of the fixing element 16 takes place.

Figure 3F:
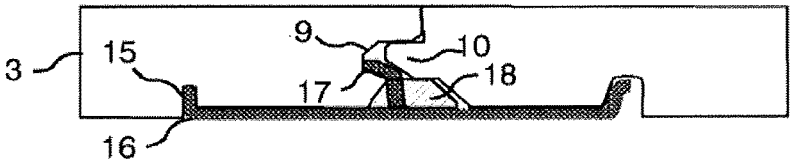

FIG. 3*f* shows that the fixing element 16 may be pressed into the core 3 and the fixing groove 15 is formed by the fixing element 16. The fixing groove may be precut with a knife. Glue may also be used to connect the clip 6 to a panel edge. Glue may in some applications replace the fixing grove 15 and the fixing element 16.

Figure 3G:
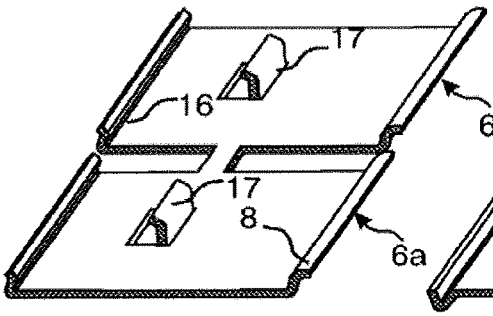
Figure 3H:
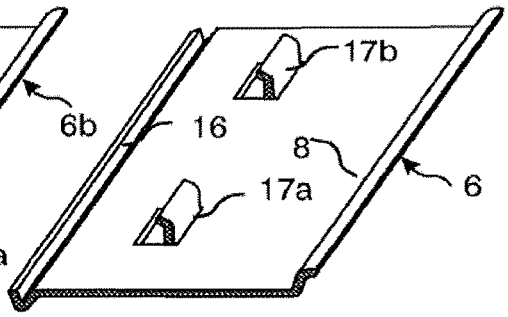

FIG. 3*g* shows that several clips 6*a*, 6*b* may be formed by punching a metal sheet and may be inserted after separation from a clip blank comprising several clips. FIG. 3*h* shows that the clip 6 may have several locking protrusions 17*a*, 17*b*.

Figure 4A:
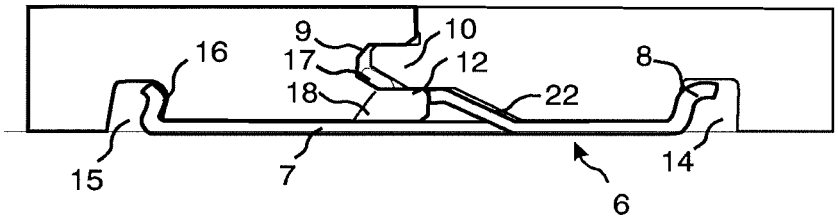
FIGS. 4*a-c* illustrate a locking system according to an embodiment of the invention.
Figure 4B:
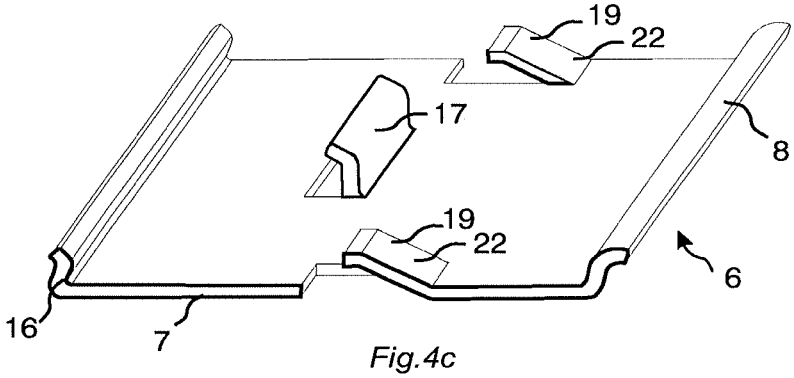
Figure 4C:
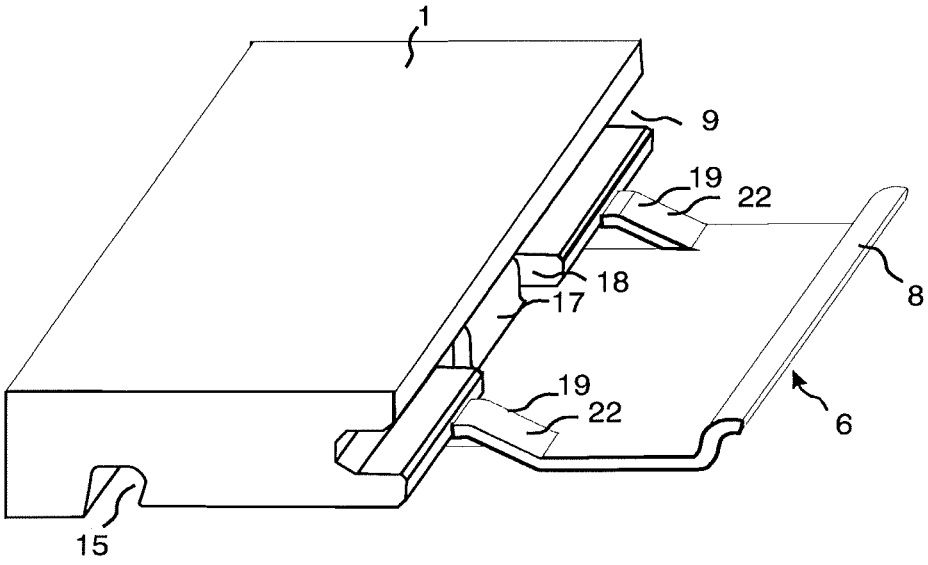
Figure 5A:
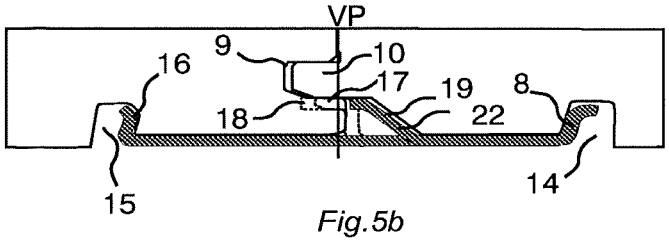
FIGS. 5*a-d* illustrate a locking system according to an embodiment of the invention.
Figure 5B:
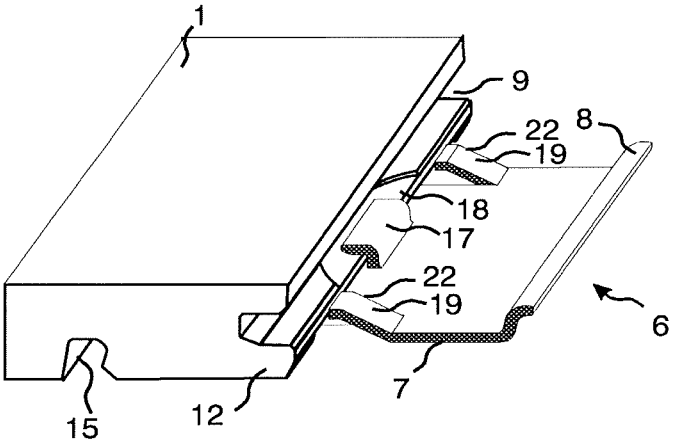
Figure 5C:
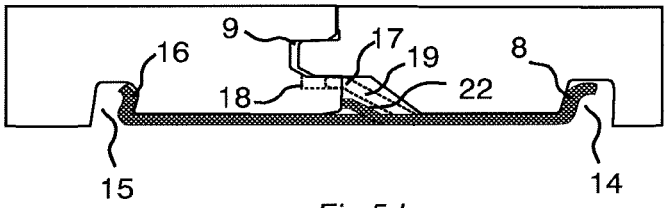
Figure 5D:
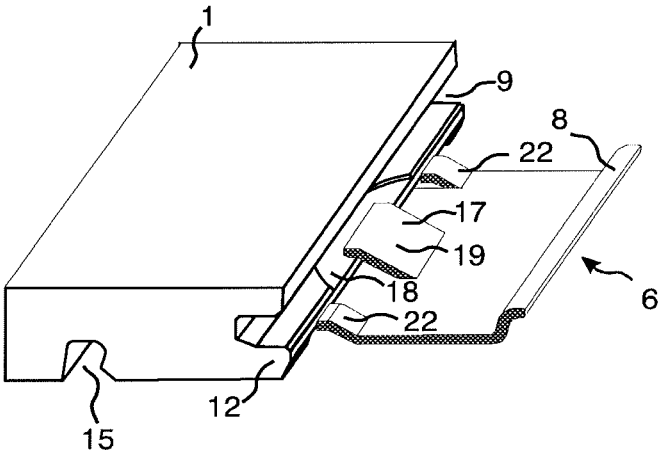

FIGS. 4*a*-4*c* show that the clip 6 may comprise guiding parts 22 having an upwardly extending sliding surface 19 that may facilitate the guiding of the tongue 10 into the tongue groove 9 during angling and/or horizontal snapping. The guiding part 22 may also be used to position the clip 6 horizontally against the lower lip 12.

FIGS. 5*a*-5*d* show that the recess 18 may be formed in an upper surface of the lower lip 12 and extend along a part of the lower lip.

Figure 6A:
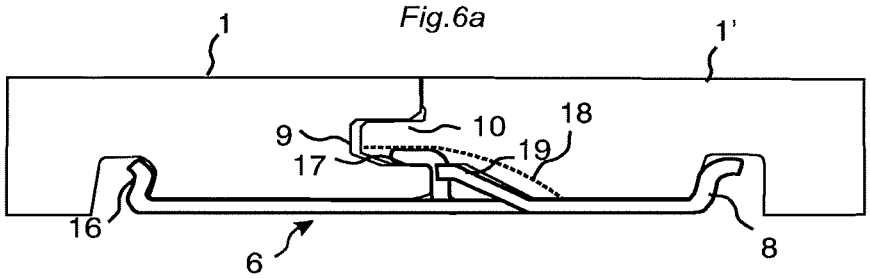
FIGS. 6*a-c* illustrate a locking system according to an embodiment of the invention.
Figure 6B:
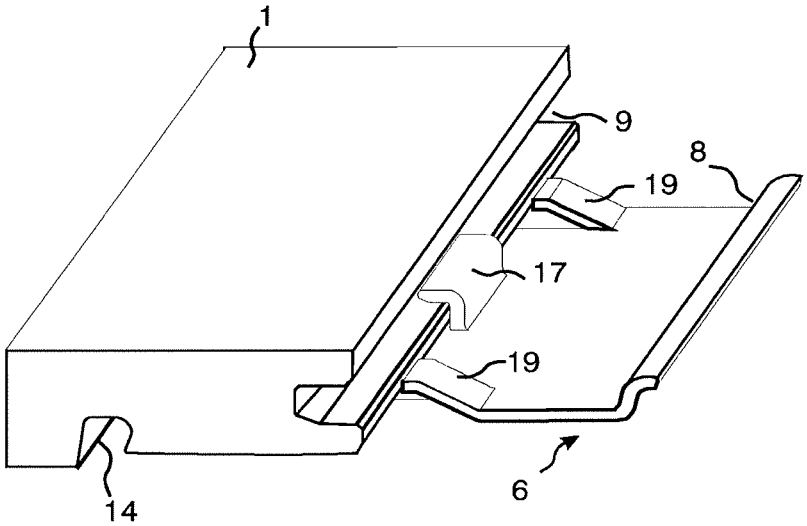
Figure 6C:
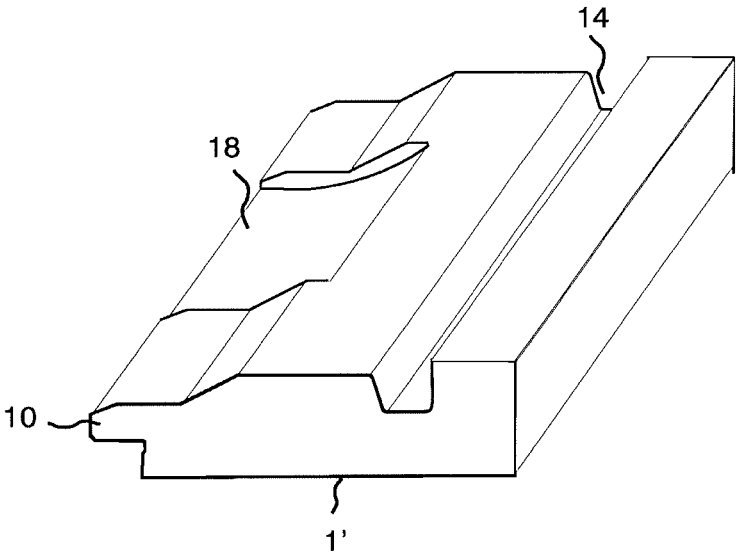

FIGS. 6*a*-6*c* show that the recess 18 may be formed in a lower part of the tongue 10 as shown in FIG. 6*c* where the panel 1' is shown with the rear side pointing upwards. The locking protrusion 17 is in locked position connected into the tongue groove 9 and located in the recess 18 formed in the lower part of the tongue 10.

Figure 7A:
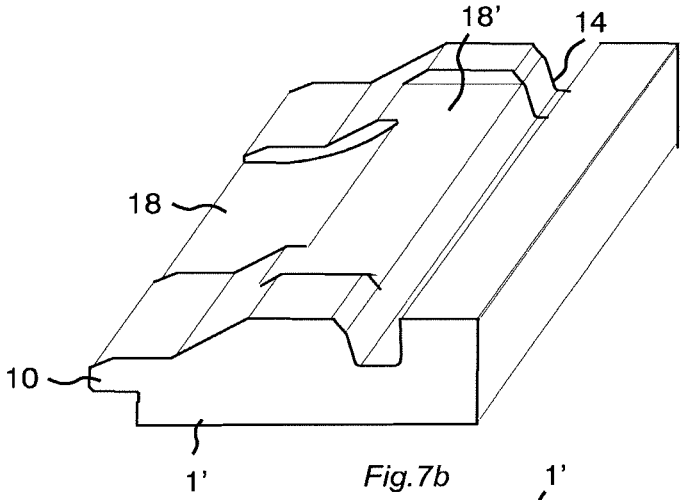
FIGS. 7*a-d* illustrate a locking system according to an embodiment of the invention.
Figure 7B:
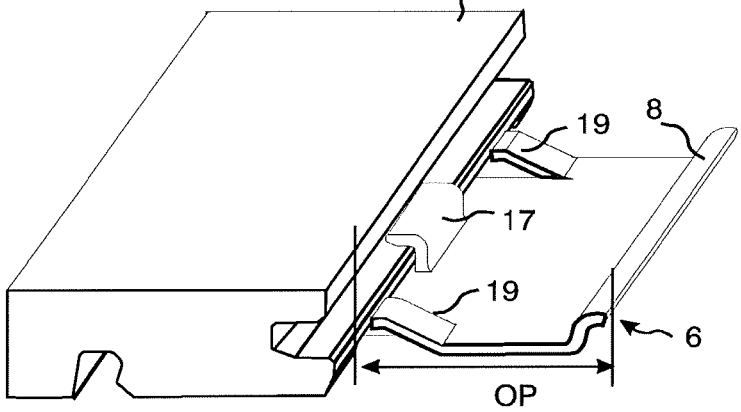
Figure 7C:
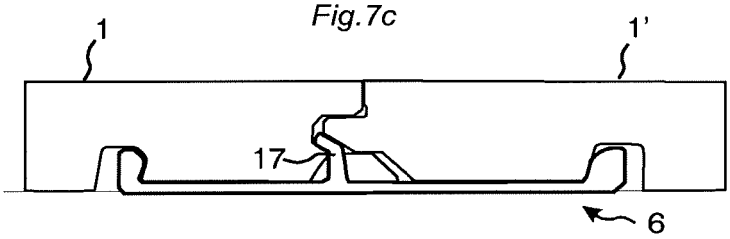
Figure 7D:
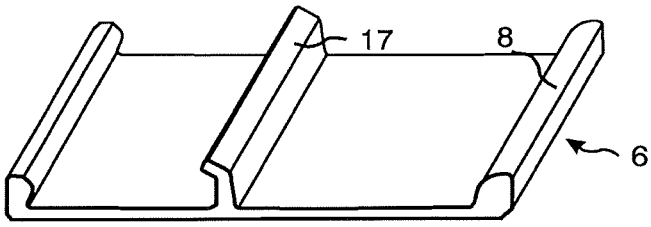

FIGS. 7*a* and 7*b* show that the recess 18, 18' may extend from the tongue 10 and to the locking groove 14 in order to accommodate the outer part OP of the clip 6 that extends beyond the upper edge of the panel 1. FIGS. 7*a* and 7*b* show that the clip 6 may be an extruded section, for example a plastic or aluminium section.

Figure 8A:
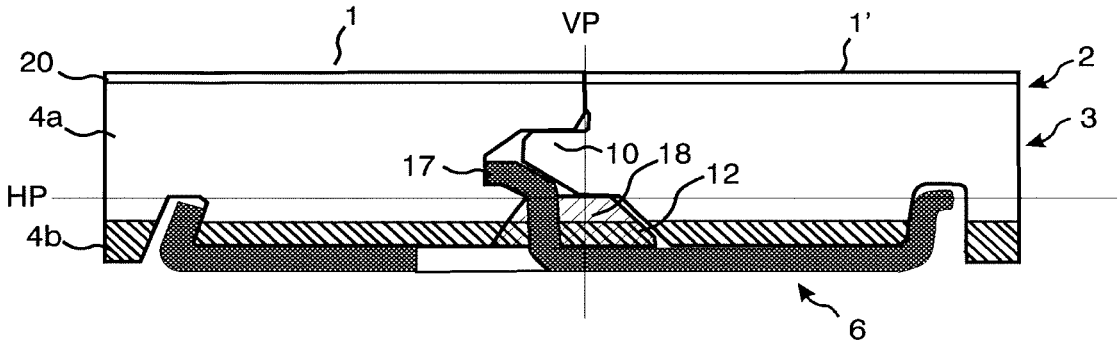
FIGS. 8*a-c* illustrate a locking system and a LVT floor panel with a core comprising several layers according to an embodiment of the invention.
Figure 8B:
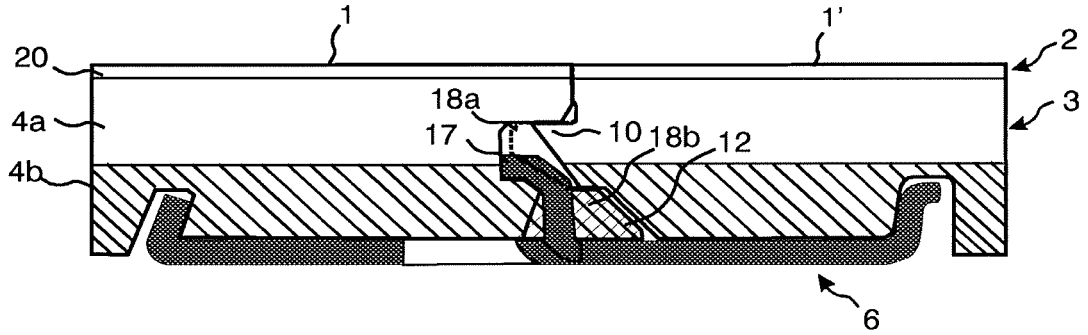
Figure 8C:
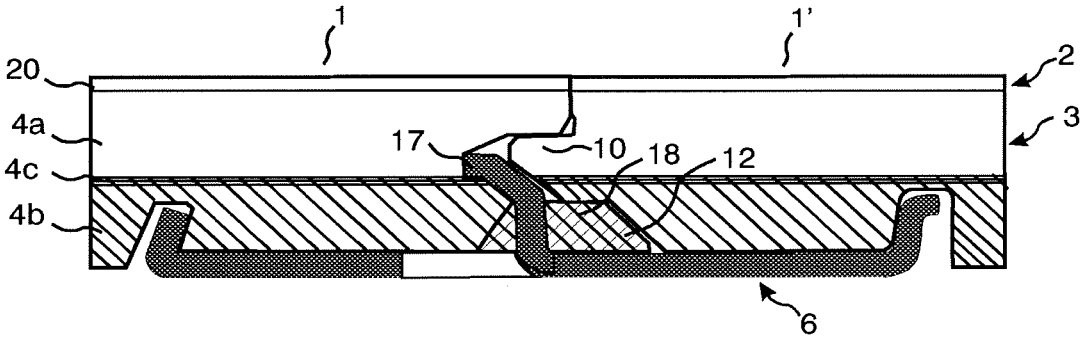

FIGS. 8*a* and 8*b* show panels 1, 1' comprising a core 3 with an upper core layer 4*a* and a lower core layer 4*b* layer and wherein the locking protrusion 17 protrudes vertically beyond the lower layer 4*b*. FIG. 8*c* shows that the core 3 may comprise a glass fibre layer 4*c* and the upper part of the locking protrusion may be located above such glass fibre layer 4*c*.

Figure 9A:
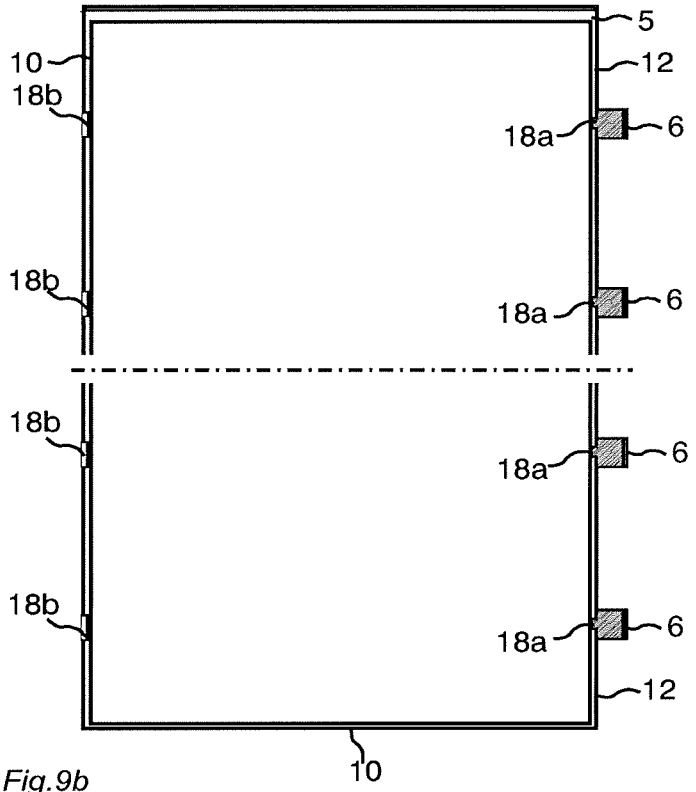
FIGS. 9*a-b* illustrate a panels with clips on long and short edges according to an embodiment of the invention.
Figure 9B:
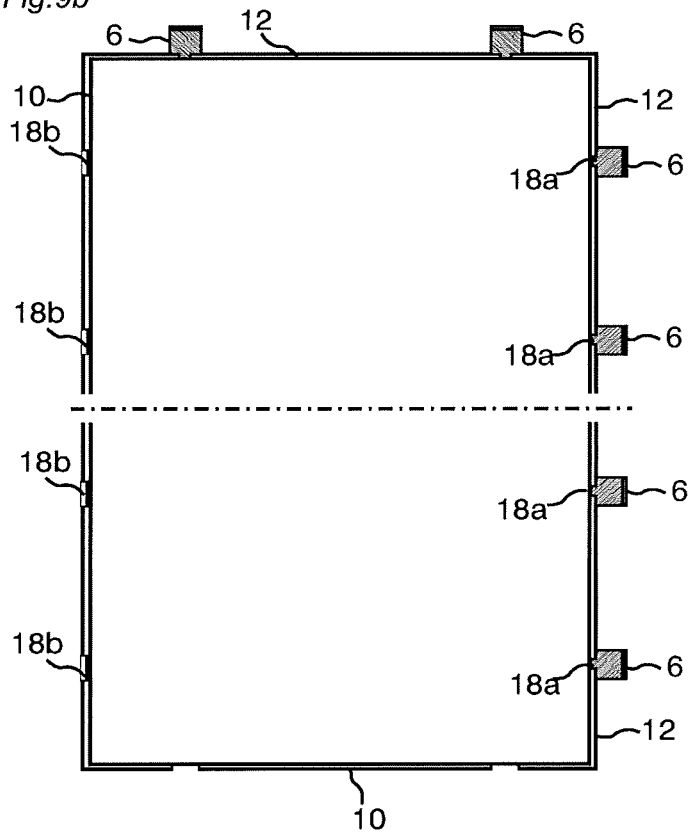

FIG. 9*a* shows a floor panel 1 comprising several clips 6 and recesses 18*a* on one of the long edges and several recesses 18*b* on the opposite long edge. The panel comprises a locking system on the short edges that is formed in one piece with the core. FIG. 9*b* shows a locking system comprising clips 6 on long and short edges.

FIGS. 10*a*-10*e* show that all embodiment of this disclosure may be adapted such that a flooring system may comprise a first A panel and a second B panel comprising clips 6 on at least two opposite edges, a first edge 23*a* and a second edge 23*b*. The locking system is configured such that a first edge 23*a* of a first A panel may be locked to a second edge 23*b* and a first edge 23*a* of a second panel B.

Figure 10A:
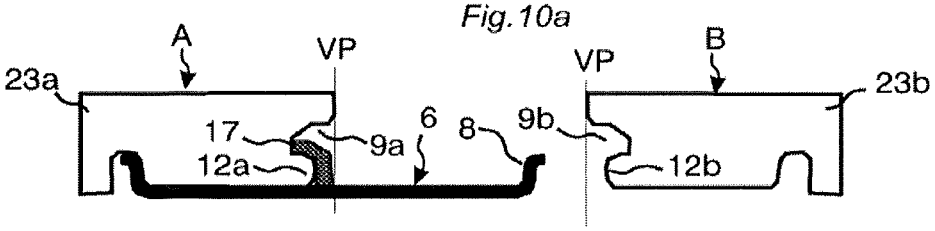
FIGS. 10*a*-10*e* illustrate A and B panels comprising clips on both adjacent edges.
Figure 10B:
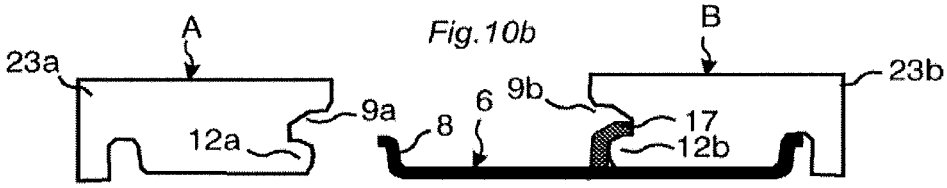
Figure 10C:
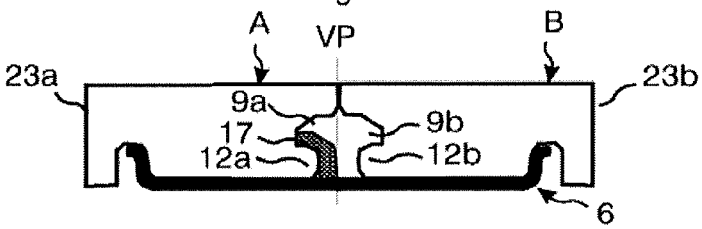
Figure 10D:
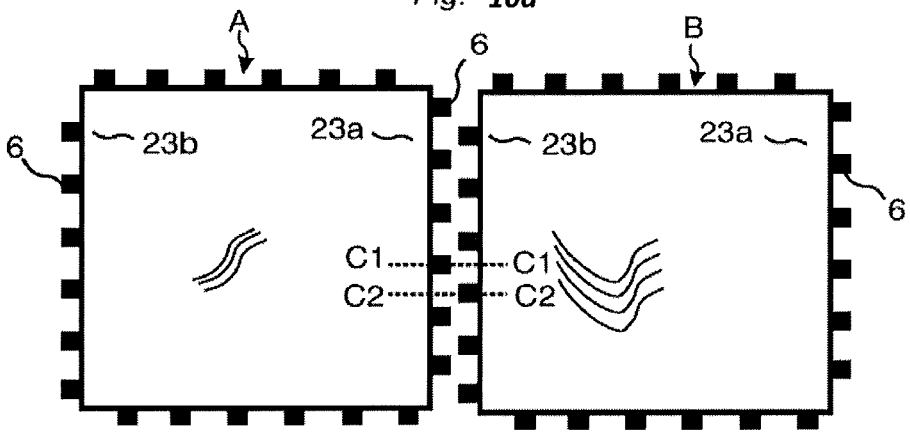
Figure 10E:
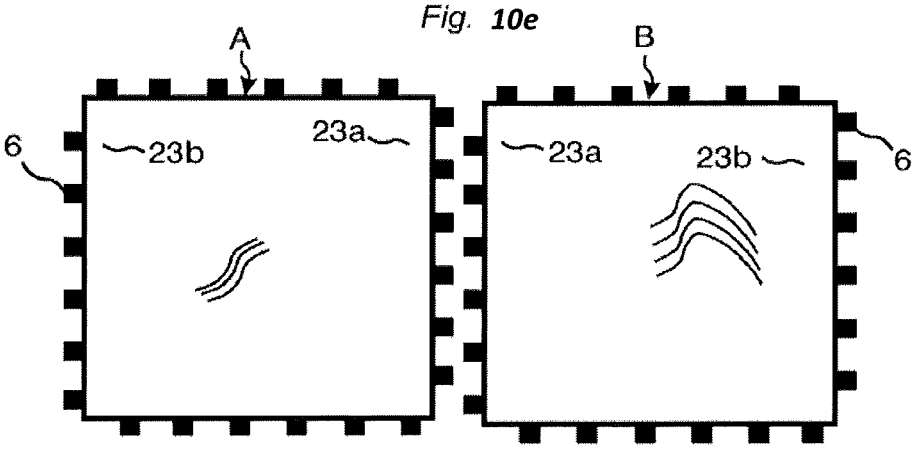

FIG. 1*a* shows a cross section C1-C1 of two adjacent edges 23*a* and 23*b* according to FIG. 10*e*. Both edges comprise a horizontal groove 9*a* and 9*b* and a lower lip 9*a*, 9*b*. The locking protrusion 17 is preferably located essentially above the lower lip 12*a* and the lower lip is preferably spaced horizontally from the vertical plane VP.

FIG. 10*b* show the cross section C2-C2 in FIG. 10*d* and FIG. 10*c* shows the cross section C1-C1 in locked position.

The clips are offset along the adjacent edges such that they may be inserted between each other.

FIG. 10*d* shows that a first edge 23*a* of a first panel A may be locked to a second edge 23*b* of a second panel B. FIG. 10*e* shows that a first edge 23*a* of the first panel A may also be connected to a first edge 23*a* of the second panel B.

The above-described locking system may be used to lock all types of floor panels. Ceramic tiles may be installed with a space between the upper edges. This allows that the outer part of the lower lip 12 may be located at the vertical plane VP or may even protrude horizontally beyond the vertical plane VP and the upper part of the edge.

Embodiments

1. Building panels provided with a locking system comprising a tongue (10) at a second edge of a second panel (1'), the tongue being configured to cooperate with a tongue groove (9) at a first edge of a first panel (1) for locking in a vertical direction, the tongue groove (9) comprising an upper lip (11) and a lower lip (12), the locking system further comprising one or more clips (6) attached to the first edge and a downwardly open locking groove (14) formed at the second edge, each clip (6) comprises an upwardly extending locking element (8), which is configured to cooperate with the locking groove (14) for locking the first edge and the second edge in a horizontal direction characterized in:

that the clip (6) comprises a clip body (7) at a rear side of the first panel (1), said clip body (7) is provided with an inner part (IP), which extends inwardly from the first edge, and an outer part (OP), which extends outwardly from said first edge, that the inner strip part (IP) comprises a fixing element (16) that cooperates with a downwardly open fixing groove (15), formed on the rear side of the first panel (1), for locking the clip (6) to the first edge in a horizontal direction, that the clip (6) comprises a locking protrusion (17), which protrudes upwardly from the clip body (7), said locking protrusion (17) is configured to lock the clip (6) to the first edge in a vertical direction, the lower lip (12) or the tongue (10) comprises a recess (18), and that the locking protrusion (17) is in a locked position positioned in the recess (18).

2. The building panels as in embodiment 1, wherein a part of the locking protrusion (17) is located in the tongue groove (9).

3. The building panels as in embodiment 1 or 2, wherein a part of the locking protrusion (17) is located below the tongue (10).

4. The building panels as in any one of the preceding embodiments 1-3, wherein said locking protrusion (17) is spaced horizontally inwardly in the tongue groove (9) beyond the outer tip of the tongue (10)

5. The building panels as in any one of the preceding embodiments 1-5, wherein the locking protrusion (17) comprises a first part (17*a*) that extends upwardly from the clip body (7) and a second part (17*b*) that extends inwardly into the tongue groove (9).

6. The building panel as in any one of the preceding embodiments 1-5 wherein the locking protrusion is located inwardly and spaced horizontally from the vertical plane 7. The building panels as in any one of the embodiments 1-6, wherein the panel comprises a core of plastic material 8. The building panels as in any one of the preceding embodiments 1-7, wherein the panel comprises a surface of thermoplastic material 9. The building panels as in any one of the preceding embodiments 1-8, wherein the panel comprises a core (3) with an upper core layer (4*a*) and a lower core layer (4*b*) and wherein the locking protrusion (17) protrudes vertically beyond the lower core layer (4*b*).

10. A flooring system comprising a first panel (A) and a second panel (B) being provided with a locking system comprising clips, said clips (6) being arranged at a first edge (23*a*) and at an opposite second edge (23*b*) of the first and the second panel (A,B), characterized in that the locking system is configured to lock the first edge (23*a*) of the first panel (A) to the second edge (23*b*) of the second panel (B) in a horizontal and a vertical direction.

11. The flooring system as in embodiment 10, wherein the first edge (23*a*) and the second edge (23*b*) each comprises a horizontal groove (9*a*, 9*b*) comprising a lower lip (12*a*, 12*b*).

12. The flooring system as in embodiment 11, wherein each clip (6) comprises a vertically extending locking protrusion (17) with an upper part that is located essentially above the lower lip (12*a*, 12*b*) of the first and the second panel, respectively.

13. The flooring system as in embodiment 12, wherein each lower lip is spaced horizontally and inwardly from an upper part of the edge.

The invention claimed is:

1. Building panels provided with a locking system comprising a tongue groove at a first edge of a first panel, the tongue groove being configured to cooperate with a tongue at a second edge of a second panel for locking in a vertical direction and the tongue groove comprising an upper lip and a lower lip, wherein the locking system further comprises one or more clips configured to be attached to the first edge, wherein an inner part of each clip comprises a fixing element configured to cooperate with a downwardly open fixing groove provided in a rear side of the first panel for locking the one or more clips to the first edge in a horizontal direction, and wherein each clip comprises a locking protrusion protruding upwardly, said locking protrusion being configured to lock the one or more clips to the first edge in a vertical direction, wherein the lower lip or the tongue comprises a recess, the locking protrusion being positioned in said recess in a locked position, wherein the locking system comprises a sliding surface configured to guide the tongue into the tongue groove during locking and/or to position the one or more clips horizontally against the lower lip, and wherein a length direction extends along the first and second edges perpendicularly to the vertical and horizontal directions, and wherein in the locked position, the locking protrusion does not extend beyond the recess in the length direction.

2. The building panels according to claim 1, wherein each clip comprises at least one guiding part comprising said sliding surface.

3. The building panels according to claim 2, wherein said at least one guiding part engages with the lower lip in the locked position.

4. The building panels according to claim 1, wherein the sliding surface is an upwardly extending or inclined sliding surface.

5. The building panels according to claim 1, wherein the lower lip comprises said sliding surface.

6. The building panels according to claim 1, wherein the locking system further comprises a downwardly open locking groove formed at the second edge and wherein each clip comprises an upwardly extending locking element, which is configured to cooperate with the locking groove for locking the first edge and the second edge in a horizontal direction.

7. The building panels according to claim 6, wherein the locking protrusion is provided between the locking element and the fixing element.

8. The building panels according to claim 1, wherein the recess extends along a portion of the first edge or second edge.

9. The building panels according to claim 1, wherein a part of the locking protrusion is located in the tongue groove.

10. The building panels according to claim 1, wherein a part of the locking protrusion is located below the tongue.

11. The building panels according to claim 1, wherein said locking protrusion is spaced horizontally inwardly in the tongue groove beyond an outer tip of the tongue.

12. The building panels according to claim 1, wherein the locking protrusion comprises a first part extending upwardly from a clip body and a second part extending inwardly into the tongue groove.

13. The building panel according to claim 1, wherein the locking protrusion is located inwardly and spaced horizontally from a vertical plane defined by immediately juxtaposed upper parts of the first edge and the second edge, the vertical plane being provided perpendicularly to a horizontal plane extending parallel to a front side of the first panel and the second panel.

14. The building panels according to claim 1, wherein the first panel and the second panel comprise a core of plastic material and/or a surface of thermoplastic material.

15. The building panels according to claim 1, wherein the first panel and the second panel comprise a core with an upper core layer and a lower core layer and wherein the locking protrusion protrudes vertically beyond the lower core layer.

16. The building panels according to claim 1, wherein the recess extends vertically from an upper to a lower part of the lower lip.

17. The building panels according to claim 1, wherein the locking system is configured to be locked with angling and/or horizontal snapping.

18. The building panels according to claim 1, wherein the inner part extends inwardly from the first edge and an outer part of each clip extends outwardly from the first edge.

* * * * *